United States Patent [19]

DePinto

[11] 4,034,767

[45] July 12, 1977

[54] CIGARETTE HOLDER

[76] Inventor: Sergio DePinto, 97 Houston St., Staten Island, N.Y. 10302

[21] Appl. No.: 716,965

[22] Filed: Aug. 23, 1976

[51] Int. Cl.[2] ..... A24D 1/12; A24D 5/10

[52] U.S. Cl. ..... 131/175; 131/178

[58] Field of Search ..... 131/175, 174, 178

[56] References Cited

U.S. PATENT DOCUMENTS

| | | | |
|---|---|---|---|
| 2,510,995 | 6/1950 | Mockel | 131/175 |
| 2,663,300 | 12/1953 | De Pinto | 131/175 |
| 2,777,447 | 1/1957 | Gossler | 131/178 |
| 2,794,439 | 6/1957 | Patry | 131/175 |
| 3,916,916 | 11/1975 | Bramucci | 131/175 |

*Primary Examiner*—Stephen C. Pellegrino

[57] ABSTRACT

A cigarette holder having a stem, mouthpiece and ash container at the end of the stem remote from the mouthpiece, has a spring inside the hollow channel of the stem which urges a cigarette towards the ash container, a stop being provided to limit the movement of the cigarette and position the lit end centrally in the container. The stop forms part of an end plug which includes a writing implement. The internal cylindrical surface of the stem is provided with longitudinal ribs which guide the cigarette along the axis of the stem. The ribs are angularly spaced from each other to thereby support a cigarette at limited selective areas thereof to minimize the frictional forces between the stem and the cigarette as the same slidingly advances along the axis towards the ash container to compensate for portions of the cigarette which are converted into ashes and deposited in the ash container. Means are provided on the ash container for admitting air but preventing the escape of ashes therefrom. Means are also provided to limit heat transfer from the ash container to the stem as well as to the end plug. The cigarette holder encloses the lit portion of a cigarette, prevents the scattering of ashes, and permits the cigarette holder with a lit cigarette therein to be placed on any surface without damaging the same.

10 Claims, 6 Drawing Figures

CIGARETTE HOLDER

BACKGROUND OF THE INVENTION

The present invention generally relates to smoking devices, and more specifically to an improved cigarette holder.

Numerous cigarette holders are known. However, most of these merely securely receive one end of a cigarette and form an extension thereof. The unsupported or lit end is fully exposed and represents a hazard, particularly in some instances such as smoking in bed. The dangers of exposed lit cigarettes are of two basic types. The first is the danger of flying burning cinders, particularly in a windy environment. The second is the danger of depositing a lit cigarette on a surface or in an area which permits the cigarette to ignite combustible material. Sometimes a lit cigarette is inadvertently placed on a table, for example, or falls off an ash tray. Aside from the damage which may be caused to the table, a resulting fire may result in great damage to property and injury to life.

The conventional cigarette holders are not intended or designed to fully enclose a cigarette, and therefore the lit end, and consequently are not adapted to prevent the types of hazards above suggested.

Some cigarette holders are known which are intended to eliminate the above hazards. However, most of these do not function properly. Others are very complicated in construction and therefore expensive to manufacture. One such prior art holder is described in my U.S. Pat. No. 2,663,300. My earlier construction included many parts or components. Accordingly, assembly and maintenance was time consuming and inconvenient. A major disadvantage of the earlier construction was that it did not operate properly or efficiently. A metal sleeve was used to support the non-lit end of the cigarette. The sleeve had a diameter substantially corresponding to the inner diameter of the holder stem and was arranged for sliding movement within the stem. Because of buildups of tars or the like within the stem, there developed frictional forces between the sleeve and the stem about the entire periphery of the sleeve. Although the sleeve was biassed by a spring, it would frequency jam and thereby prevent the proper advancement of the cigarette. Additionally, the ash container, which normally encloses the lit end, was not thermally insulated from the other portions of the cigarette holder. This sometimes made the holder uncomfortably hot to hold or touch.

SUMMARY OF THE INVENTION

Accordingly, it is an object of the present invention to provide a cigarette holder which does not have any of the above-described disadvantages.

It is another object to provide a cigarette holder which is simple in construction and economical to manufacture.

It is still another object of the present invention to provide a holder for a cigarette holder for a cigarette which permits the same to be smoked without the hazards sometimes associated with lit cigarettes.

It is yet another object of the invention to provide a holder which fully encloses a lit cigarette and prevents the dispersion of burning cinders.

It is a further object to provide a holder for cigarettes which permits the same to be placed on a table or the like with a lit cigarette without damaging the table.

It is still a further object to provide a holder for cigarettes which consistently functions properly and efficiently while providing the above discussed advantages.

It is yet a further object to provide a cigarette holder which insures proper advancement of the cigarette within the stem by minimizing the frictional forces or drag caused by deposits of tars or the like.

It is an additional object of the invention to provide a cigarette holder which thermally insulates the ash container portion which encloses the lit end of the cigarette from the other portions of the holder to maintain the same at comfortably cool temperatures.

It is yet an additional object of the present invention to provide a cigarette holder which is disposable and which can be used to initially enclose a cigarette for smoking under hazardous conditions.

In order to achieve the above objects, as well as others which will become evident hereafter, the cigarette holder of the present invention comprises an elongate stem having a longitudinal channel therethrough defining an axis and front and rear openings at the ends thereof. An ash container is provided which is associated with one end of said stem at said front opening. Said ash container includes means for admitting air into the same. A mouthpiece is provided which is associated with the other end of said stem at said rear opening. Biassing means is provided within said longitudinal channel for urging a cigarette disposed in said longitudinal channel from said mouthpiece toward said ash container to thereby bring the lit end of the cigarette into said ash container. Stop means is provided for limiting the movement of the cigarette and maintaining the lit end of the cigarette substantially in the central portion of said ash container. Said channel of said stem is defined by an inner cylindrical surface. A plurality of radial projections extend from the cylindrical surface and have the innermost portions thereof disposed on an imaginary coaxial cylindrical surface having a diameter substantially equal to the diameter of a cigarette. Said front opening is dimensioned to slidingly receive a cigarette in sealing engagement to insure that smoke and air flow from said ash container into said stem through the cigarette. Accordingly, the cigarette is supported by said radial projections at only selected surface portions thereof and urged by said biassing means to axially move toward said container to compensate for the burned off portions of the cigarette to thereby maintain the lit end substantially centrally in said ash container. Said means for admitting air is adapted to retain burned ashes of the cigarette within said ash container. In this manner, the lit portion of the cigarette is safely enclosed in said ash container and the cigarette holder, with a lit cigarette therein, can be left on any surface without damaging the same.

In the presently preferred embodiment, said radial projections are in the nature of longitudinal ribs parallel to said axis which are angularly spaced from each other about said inner cylindrical inner surface. The preferred holder advantageously includes heat transfer limiting means for decreasing or limiting excessive heat flow from said ash container to said stem and said stop means, and writing means on said stop means to permit the holder to be used as a writing implement.

DESCRIPTION OF THE DRAWINGS

The present invention will be better understood from the description of the presently preferred embodiment when taken together with the drawings thereof in which.

DESCRIPTION OF THE PREFERRED EMBODIMENT

Figure 1:
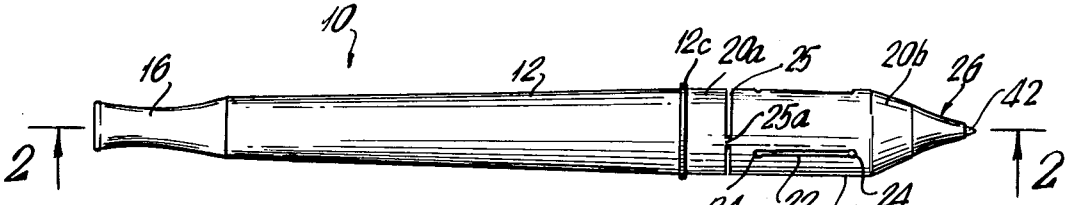
FIG. 1 is a side elevational view of the presently preferred embodiment of the cigarette holder in accordance with the present invention, shown fully assembled.
Figure 2:
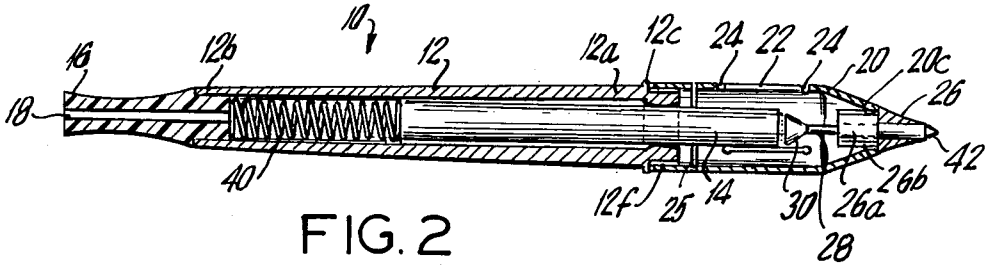
FIG. 2 is a longitudinal section of the holder of FIG. 1, taken on line 2—2, showing a typical position of a lit cigarette during smoking of the same.
Figure 3:
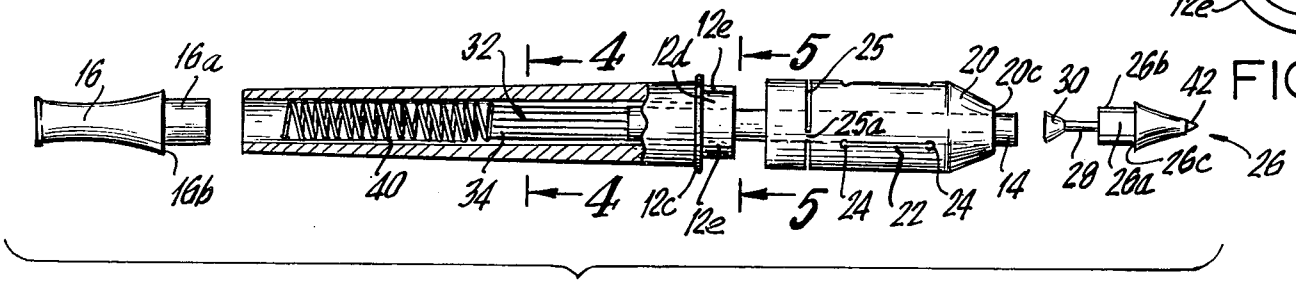
FIG. 3 is similar to FIG. 1, but showing the holder in an exploded view to illustrate how the holder is assembled.

Referring now specifically to the drawings, in which the identical or similar parts are identified by the same reference numerals throughout, and first referring to FIGS. 1–3, the presently preferred embodiment of the present invention of the cigarette holder is generally identified by the reference numeral 10.

The cigarette holder 10 has a generally elongate cylindrical stem 12 which is hollow as shown and defines an axis. The stem has a front portion 12*a* and a rear portion 12*b*, which portions include front and rear openings respectively.

Figure 5:
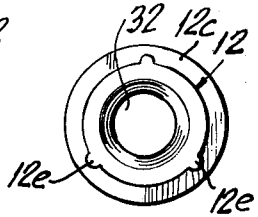
FIG. 5 is a cross-sectional view of the holder shown in FIG. 3, taken along line 5—5.
Figure 6:
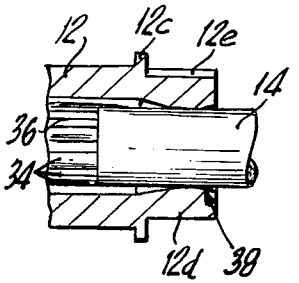
FIG. 6 is an enlarged fragmented view of a portion of the holder shown in FIG. 2, showing the manner in which the cigarette is slidingly and sealingly supported at the end of a stem of the holder proximate to an ash container.

An annular rim 12*c* separates the main portion of the stem 12 from a forwardly projecting shank 12*d* which is substantially coaxial with the stem 12 and has a outside diameter smaller than that of the rim 12*c*, as best shown in FIGS. 2, 5 and 6. A plurality of spaced parallel ribs 12*e* are provided on the shank 12*d* which are parallel to the axis of the stem 12. The radially outermost portions of the ribs 12*e* are advantageously within the diameter of the rim 12*c*, for reasons which will become evident hereafter.

The length of the stem 12 is selected to be approximately equal to the length of a conventional cigarette 14. Different length stems could be used to accomodate different length cigarettes, such as regular, king size and 100 mm.

A conventional-type mouthpiece 16 is associated with the rear stem portion 12*b* and has a longitudinal channel 18 extending therethrough as shown. As best shown in FIG. 3, the mouthpiece 16 has a forwardly projecting shank 16*a* which is cylindrical and has outer dimensions generally smaller than those of the main body portion of the mouthpiece 16 to form a bearing surface 16*b*. The shape and the dimensions of the shank 16*a* are selected to correspond to those of the rear opening of the stem 12 so that the shank 16*a* is received therein in pressure relation to provide a seal for air and smoke where the stem 12 and mouthpiece 16 are connected. It should be evident that the described construction can be modified by integrally forming the stem and the mouthpiece. Additionally, any other means for joining these members to each other can be used so long as an effective seal is formed therebetween. The stem 12 and the mouthpiece 16 may be made from any suitable material, such as metal or high temperature plastics.

In FIGS. 1–3, the right hand ends of the holder 10 will be referred to as the forward end, while the left hand ends as the rear end. However, these relative directions are only used to facilitate the description of the invention, and should not be construed as limiting the same.

At the stem front portion 12*a*, there is provided an ash container 20 which, as best shown in FIG. 2, is in the nature of a hollow tube or sleeve which has a straight rear portion 20*a* and a tapered front portion 20*b*. The straight rear portion 20*a* has a diameter smaller than that of the rim 12*c* but large enough to slidingly receive the shank 12*d* by abutting against the ribs 12*e* in pressure relation. As best shown in FIGS. 1 and 2, the ash container 20 abuts against the rim 12*c* in the fully assembled condition of the holder 10. As should be evident, arcuate spaces 12*f* are formed between the shank 12*d* and the ash container 20 when the former is received in the latter. While not critical, an air seal is advantageously formed between the ash container straight rear portion 20*a* and the rim 12*c* when the holder is in use to provide better control of the flow of gases into and out of the ash container.

The ash container 20 is associated with the front opening of the stem front portion 12*a*, and normally encloses the lit end of the cigarette 14. Accordingly, the ash container is advantageously made from a metal, such as aluminum. The ash container is provided with means to admit air thereinto. While the air admitting means may be of any suitable type, the presently preferred means is in the nature of a plurality of spaced parallel slots or cuts 22 in the ash container wall. The slots 22 are parallel to the axis of the holder 10 and are advantageously provided with small circular holes 24 or the like at the ends of the slots or cuts. The slots 22 and the holes 24 are selected to have dimensions substantially smaller than the diameter of the ash container to permit the flow of gases therethrough without permitting solid particles, such as cigarette ashes, to pass through the same. For example, the air admitting slots 22 may have widths corresponding to the thickness of a conventional razor blade. In the embodiment being described, three slots 22 are shown spaced 120° apart about the circumference of the ash container. However, it should be clear that the shape and the number of openings forming the air admitting means can be modified, with different degrees of advantage, without impairing the operation of the invention.

For reasons which will be described in more detail hereafter, there is advantageously provided on the ash container 20 a substantially continuous opening 25 which is interrupted along very short distances to form small lands or connecting portions 25*a*. The annular-like opening 25 is shown to be situated in a plane normal to the axis of the stem 12 and disposed between the slots or cuts 22 and the rearmost portion or edge of the ash container 20. While the opening 25 also serves as an air admitting means, it also serves as a heat transfer limiting means for limiting excessive flow of heat from the ash container 20 to the stem 12, as will become evident from the description that follows.

The ash container 20 has been shown to be generally cylindrical in shape and having a substantially uniform diameter along its length. However, the specific shape or configuration of the ash container is not critical and may be of any other shape or configuration, such as the substantially spherical shape shown in my earlier U.S. Pat. No. 2,663,300. The specific shape of the ash container may accordingly be modified to assume any one of a large number of ornamental shapes or configurations.

Referring to FIGS. 1–3, the tapered front portion 20*b* of the ash container 20 is provided with a coaxial opening 20*c* which is dimensioned to receive in pressure relationship a portion of an end plug 26, one of whose functions is as a stop means, as will be more fully described hereafter. The end plug 26 has a substantially cylindrical shank portion 26*a* whose diameter is selected to correspond approximately to the diameter of the opening 20*c* and to form a bearing surface 26*c* whose function is similar to that of the bearing surface formed by the annular rim 12*c*. A plurality of spaced parallel ribs 26*b* are provided on the shank 26*a* which are parallel to the axis of the stem. The radially outermost portions of the ribs 26*b* define an imaginary cylinder whose diameter is substantially equal to that of the opening 20*c* so that insertion of the end plug 26 into the ash container 20 results in a secure press fit therebetween.

Extending rearwardly along the axis from the shank 26*a* is an elongate portion or extension 28 which is terminated at the free end thereof by a stop member 30. As best shown in FIG. 2, the stop member engages or abuts against the lit end of the cigarette 14 during use of the holder 10 so that the stop member must be made from a fire or flame resistant material, such as from a metal. The specific construction of the stop member 30 is not critical, so long as it does not deform or become damaged upon being exposed to high temperatures. A stop member made of metal wire of the type shown in my earlier U.S. Pat. No. 2,663,300 may be used for this purpose.

The axial lengths of the shank 26*a*, the extension 28 and the stop member 30 are selected to limit movement of the lit end of the cigarette 14 forwardly of the central region of the ash container 20. Advantageously, the lit end of the cigarette is maintained during the entire smoking process in the central region of the slots 22 substantially midway between the holes 24. The diameter of the opening 20*c* is selected to permit passage of the cigarette 14, as shown in FIG. 3.

Figure 4:
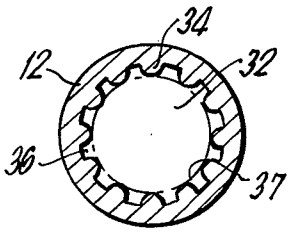
FIG. 4 is a cross-sectional view of the holder shown in FIG. 3, taken along line 4—4.

The hollow stem 12 defines a longitudinal channel 32 formed by the inner cylindrical surface of the stem 12. An important feature of the present invention is the provision of a plurality of radial projections extending from the stem inner cylindrical surface, the radial projections having the innermost portions thereof disposed on an imaginary coaxial cylindrical surface having a diameter substantially equal to the diameter of the cigarette 14. In the presently preferred embodiment, as shown in FIGS. 2–4, the radial projections are in the nature of longitudinal ribs 34 parallel to the stem axis. Advantageously, the ribs 34 are angularly spaced from each other about the stem cylindrical inner surface to form longitudinal recesses or grooves 36 as best shown in FIG. 4. Also shown in FIG. 4 is the imaginary coaxial cylindrical surface 37 defined by the innermost portions of the ribs 34. As suggested above, the diameter of the imaginary surface 37 is approximately equal to the diameter of the cigarette 14.

The ribs 34 extend substantially along the entire length of the stem 12 but terminate short of the rear portion 12*b* to insure a pressure seal at the mouthpiece 16. At the stem front portion 12*a*, the end of the channel 32 or front opening is provided with an annular constriction 38, as best shown in FIG. 6. The inside diameter of the constriction 38 is approximately equal to the diameters of the imaginary surface 37 and of the cigarette 14 and dimensioned to slidingly receive a cigarette in sealing engagement to insure that smoke and air flow into the stem 12 only through the cigarette 14 and do not bypass the same. The annular constriction 38 forms a seal when abutting against the cigarette 14 as shown in FIGS. 2 and 6 to prevent such bypassing of the cigarette.

With the construction above described, the cigarette 14 is supported coaxially within the stem 12 by the ribs 34 and the constriction 38. The ribs 34 support the cigarette at only selected surface portions thereof, thereby minimizing the frictional forces or drag against the cigarette when the same is guided or advanced within the stem.

Biassing means in the nature of a helical compression spring 40 is provided within the stem 12 at the rear portion 12*b* thereof which abuts against the shank 16*a* when the mouthpiece is mounted on the stem. The coefficient or constant of the spring 40 is selected to continuously advance the cigarette 14 against the stop member 30 without damaging the cigarette or the lit end thereof. As should be evident, the spring 40 continuously urges a lit cigarette: in the direction from the mouthpiece 16 towards the ash container 20 to thereby bring the lit end of the cigarette into the ash container and into abutment against the stop member 30. In this way, the cigarette is guided axially towards the ash container 20 to compensate for the burned off portions of the cigarette, and the lit end of the cigarette is maintained in the central region of the ash container 20. As with my previously patented device, the holder 10 is adapted to retain burned ashes of the cigarette 14. With the described construction, the lit portion of the cigarette is safely enclosed in the ash container 20, and the cigarette holder, with a lit cigarette therein, can be safely left on any surface without damaging the same.

An optional feature of the present invention comprises the provision of writing means 42 on the end plug 26 in the nature of a ball point or felt tip. In this way, the holder 10 can also be used as a writing implement when not used to smoke a cigarette.

The operation of the holder 10 will now be described to the extent to which it has not yet been described. With the holder 10 disassembled as shown in Figure, the mouthpiece 16 is connected to the stem 12 by forcing the shank 16*a* into the channel 32. Advantageously, these are snap-fitted into each other. The spring 40 is inserted into the channel 32 and the ash container 20 is similarly connected to the stem 12 by forcing the shank 12*d* of the stem into the ash container.

A cigarette 14 is then inserted through the opening 20*c* and moved rearwardly with respect to the stem 12 to pass one end of the cigarette through the constriction 38, to form the above-described seal, but maintain the end of the cigarette to be smoked extending forwardly of the ash container 20 as shown in FIG. 3. The cigarette may be lit in this condition, the effluent gases being drawn through the cigarette, the stem and the mouthpiece. Once the cigarette is lit, the end plug 26 may be used to urge the full length cigarette to its initial position shown in FIG. 2 against the action of the spring 40.

Air for combustion of the cigarette enters the ash container 20 through the slots 22, the holes 24, the opening 25 and, to a lesser extent, through the possibly imperfect seals at the points where the ash container 20 is connected or joined to the shanks 12*d* and 26*a*. The effluent gases or smoke escape through the aforementioned openings which admit combustion air. However, most of the smoke flows through the cigarette 14, the stem 12 and the mouthpiece 16. Since the ash container is normally filled with smoke, and since combustion air is only admitted in appreciable amounts when the smoker puffs on the cigarette, the cigarette burns more slowly and provides a longer smoke when useing the present device.

It will be noted, particularly in FIG. 3, that the ash container 20 makes contact with the shanks 12*d* and 26*a* only at the ribs 12*e* and 26*b* respectively. In this sense, the ribs 12*e* and 26*b* act as standoffs or heat transfer limiting means. Clearly, since the lit end of the cigarette is normally disposed within the ash container 20, this is where most of the heat is released. The use of a few ribs 12*e* and 26*b*, such as three ribs spaced 120° apart, reduces the surface contact area between the ash container and the members connected thereto and thereby reduces the heat transfer therebetween. For the same reason, the opening 25 is substantially continuous but provided with small lands or connecting portions 25*a* to limit the contact area between the main body portion of the ash container and the portion thereof connectable to the stem 12. The provision of such heat transfer limiting means prevents the holder 10 from becoming uncomfortably hot to hold or touch. Furthermore, the holder 10 is totally safe and may be smoked under many hazardous conditions.

To empty the ash container 20 after the cigarette has been fully consumed, the end plug 26 may be separated from the ash container and the ashes expelled through the opening 20*c*. Alternately, the ash container 20 and the end plug 26 may be separated from the stem 12 in which case the ashes may be expelled through the rear opening of the ash container. Although the ribs 34 maintain friction and drag to a minimum, a small brush or other suitable cleaning implement is advantageously passed through the stem or channel to remove any deposits of tar or the like on the ribs 34. Such maintenance reduces the possibility of "wetting" the cigarette paper by buildups of deposits of tars or the like which would materially increase the frictional or drag forces on the cigarette.

As will be evident from the description, the present holder, in its presently preferred embodiment, has only five parts — the stem 12, the mouthpiece 16, the ash container 20, the end plug 26 and the spring 40. This is to be contrasted with the holder disclosed in my earlier patent which had many more parts and, therefore, was more difficult and expensive to manufacture, and more inconvenient to use and maintain. What is even of more importance is that the present holder more consistently and efficiently than did the earlier holder because of the present improved constructional features which did not exist in the earlier model.

Based on the present disclosure, many changes in constructional details will become evident to those skilled in the art. However, the present invention contemplated any and all such changes or modifications which do not depart from the scope and spirit of the present invention.

What is claimed is:

1. A cigarette holder comprising an elongate stem having a longitudinal channel therethrough defining an axis and front and rear openings at the ends thereof; an ash container associated with one end of said stem at said front opening, said ash container including means for admitting air thereinto; a mouthpiece associated with the other end of said stem at said rear opening; biassing means provided within said longitudinal channel for urging a cigarette disposed in said longitudinal channel from said mouthpiece towards said ash container to thereby bring the lit end of the cigarette into said ash container; stop means for limiting the movement of the cigarette and maintaining the lit end of the cigarette substantially in the central portion of said ash container, said channel being defined by an inner cylindrical surface of said stem, said stop means including a coaxial end plug having a stop member projecting into said ash container a distance selected to maintain the lit end of the cigarette substantially in the central region of said ash container; a plurality of radial projections extending from said cylindrical surface and having the innermost portions thereof disposed on an imaginary coaxial cylindrical surface having a diameter substantially equal to the diameter of a cigarette, said front opening being dimensioned to slidingly receive a cigarette in sealing engagement to insure that smoke and air flow from said ash container into said stem primarily through the cigarette; and heat transfer limiting means between said ash container and said end plug, whereby the cigarette is supported by said radial projections at only selected surface portions thereof and urged by said biassing means to axially move towards said ash container to compensate for burned off portions of the cigarette to thereby maintain the lit end substantially centrally in said ash container, said means for admitting air being adapted to retain the burned ashes of the cigarette within said ash container, and whereby the lit portion of the cigarette is safely enclosed in said ash container, and the cigarette holder, with a lit cigarette therein, may be left on a surface without damaging the same.

2. A cigarette holder comprising an elongate stem having a longitudinal channel therethrough defining an axis and front and rear openings at the ends thereof; an ash container associated with one end of said stem at said front opening, said ash container including means for admitting air thereinto; a mouthpiece associated with the other end of said stem at said rear opening; biassing means provided within said longitudinal channel from said mouthpiece towards said ash container to thereby bring the lit end of the cigarette into said ash container; stop means for limiting the movement of the cigarette and maintaining the lit end of the cigarette substantially in the central portion of said ash container, said channel being defined by an inner cylindrical surface of said stem; a plurality of radial projections extending from said cylindrical surface and having the innermost portions thereof disposed on an imaginary coaxial cylindrical surface having a diameter substantially equal to the diameter of a cigarette, said front opening being dimensioned to slidingly receive a cigarette in sealing engagement to insure that smoke and air flow from said ash container into said stem primarily through the cigarette; and heat transfer limiting means between said ash container and stem, whereby the cigarette is supported by said radial projections at only selected surface portions thereof and urged by said biassing means to axially move towards said ash container to compensate for burned off portions of the cigarette to thereby maintain the lit end substantially centrally in said ash container, said means for admitting air being adapted to retain the burned ashes of the cigarette within said ash container, and whereby the lit portion of the cigarette is safely enclosed in said ash container, and the cigarette holder, with a lit cigarette therein, may be left on a surface without damaging the same.

3. A holder as defined in claim 2, wherein said radial projections comprise longitudinal ribs parallel to said axis.

4. A holder as defined in claim 3, wherein said ribs are angularly spaced from each other about said cylindrical inner surface.

5. A holder as defined in claim 2, wherein said ash container comprises a cylindrical member, and said means for admitting air comprises a plurality of opening in the wall of said cylindrical member.

6. A holder as defined in claim 5, wherein said openings include longitudinally extending slots substantially parallel to said axis.

7. A holder as defined in claim 2, wherein said stop means includes a coaxial end plug having a stop member projecting into said ash container a distance selected to maintain the lit end of the cigarette substantially in the central region of said ash container.

8. A holder as defined in claim 7, wherein said end plug includes means for writing mounted thereon, whereby the cigarette holder may also be used as a writing implement.

9. A holder as defined in claim 2, wherein said biassing means comprises a helical compression spring.

10. A holder as defined in claim 2, further comprising heat transfer limiting means between said ash container and said stop means.

* * * * *